US007806652B2

(12) United States Patent
Major et al.

(10) Patent No.: US 7,806,652 B2
(45) Date of Patent: Oct. 5, 2010

(54) TURBINE ENGINE VARIABLE STATOR VANE

(75) Inventors: Daniel W. Major, Middletown, CT (US); Edward Torres, Newington, CT (US); William J. Speers, III, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 818 days.

(21) Appl. No.: 11/733,233

(22) Filed: Apr. 10, 2007

(65) Prior Publication Data

US 2008/0253882 A1 Oct. 16, 2008

(51) Int. Cl.
*F01D 17/16* (2006.01)

(52) U.S. Cl. ..... 415/160; 416/223 R

(58) Field of Classification Search ..... 415/148, 415/151, 155, 159, 160, 163, 165; 416/223 R, 416/226, 234, 239, 236 R, 243
See application file for complete search history.

(56) References Cited

U.S. PATENT DOCUMENTS 4,214,852 A * 7/1980 Tuley et al. ..... 415/115
5,328,327 A * 7/1994 Naudet ..... 415/160
5,636,968 A * 6/1997 Audet et al. ..... 415/160
6,129,512 A * 10/2000 Agram et al. ..... 415/160
6,283,705 B1 * 9/2001 Rice et al. ..... 415/160
6,461,105 B1 * 10/2002 Nicolson ..... 415/160
7,125,222 B2 * 10/2006 Cormier et al. ..... 415/160

* cited by examiner

*Primary Examiner*—Igor Kershteyn
(74) *Attorney, Agent, or Firm*—Carlson, Gaskey & Olds, P.C.

(57) ABSTRACT

A turbine engine variable stator vane includes a platform having a circumference adjoining opposing surfaces. A trunnion extends from one of the opposing surfaces. An airfoil is supported on the other of the opposing surfaces opposite the trunnion. The airfoil includes leading and trailing edges. An overhanging portion of the airfoil, which includes the trailing edge, extends beyond the circumference. A fillet joins the airfoil and the other opposing surface and extends along the other opposing surface in a lateral direction beyond the circumference toward the trailing edge. In one example, the fillet is provided about the entire perimeter of the airfoil. The airfoil includes pressure and suction sides. The circumference includes a relief cut extending from the suction side and adjoining a notch in the circumference to form an apex overlying the end surface.

17 Claims, 4 Drawing Sheets

TURBINE ENGINE VARIABLE STATOR VANE

BACKGROUND

This application generally relates to turbine engines, and more particularly, to a variable stator vane.

A turbine engine typically includes multiple compressor stages. Circumferentially arranged stators are positioned axially adjacent to the compressor blades, which are supported by a rotor. Some compressors utilize variable stator vanes in which the stators possess inboard and outboard journals or trunnions supporting axial rotation. The high pressure compressor case supports outboard variable vane trunnions or OD trunnions while a segmented split ring supports inboard variable vane trunnions or ID trunnions.

Each stator vane includes an airfoil that extends between inner and outer platforms, or buttons. Trunnions extend from each of the platforms and are supported for rotation by the inner and outer cases. In one type of variable stator vane, a leading edge of the airfoil is inset relative to the circumferences of the platforms. A trailing edge of the airfoil extends beyond, or overhangs, the circumferences of the platforms. The transition area between the airfoil and the platforms must be designed to minimize stress.

One approach to minimize stress in the stator vane is to provide a transition fillet between the airfoil and the platforms. A fillet extends between the airfoil and each platform from the point where the airfoil trailing edge overhangs the circumference and wraps around the leading edge to the opposite side of the airfoil, terminating where the airfoil overhangs the circumference on the adjacent side. Stator vanes are still subject to stress in this transition area despite the use of fillets.

Another approach, which is sometimes used in combination with the above approach, is to make a single relief cut or slab-cut interfacing the trailing edge. An additional transition fillet is then applied to the slab-cut and the interfacing airfoil trailing edge. The slab-cut fillet adjoins the airfoil fillet, producing a continuous blend between the airfoil and its respective platforms. Structural optimization balances slab-cut material removal against fillet size and trailing edge overhang. Excessive trailing edge overhang often required for aerodynamic efficiency, is not conducive to structural optimization resulting in a variable vane susceptible to stress risers.

What is needed is a variable stator vane that includes features for minimizing the possibility of forming stress risers in transitional areas between the overhanging portion of the airfoil and the platforms during manufacture of the stator vane.

SUMMARY

A turbine engine variable stator vane includes a platform having a circumference adjoining opposing surfaces. A trunnion extends from one of the opposing surfaces. An airfoil is supported on the other of the opposing surfaces opposite the trunnion. The airfoil includes leading and trailing edges. An overhanging portion of the airfoil, which includes the trailing edge, extends beyond the circumference. A fillet joins the airfoil and the other opposing surface and extends along the other opposing surface in a lateral direction beyond the circumference toward the trailing edge. In one example, the fillet is provided about the entire perimeter of the airfoil.

The airfoil includes pressure and suction sides. An end surface of the airfoil extends beyond the circumference and is generally planar, in one example. The circumference includes a relief cut extending from the suction side and adjoining a notch in the circumference to form an apex overlying the end surface. In one example, the notch includes a radius that overlaps the fillet. Transition surfaces slope from the relief cut and notch to the end surface.

These and other features of the application can be best understood from the following specification and drawings, the following of which is a brief description.

DETAILED DESCRIPTION OF THE PREFERRED EMBODIMENT

Figure 1:
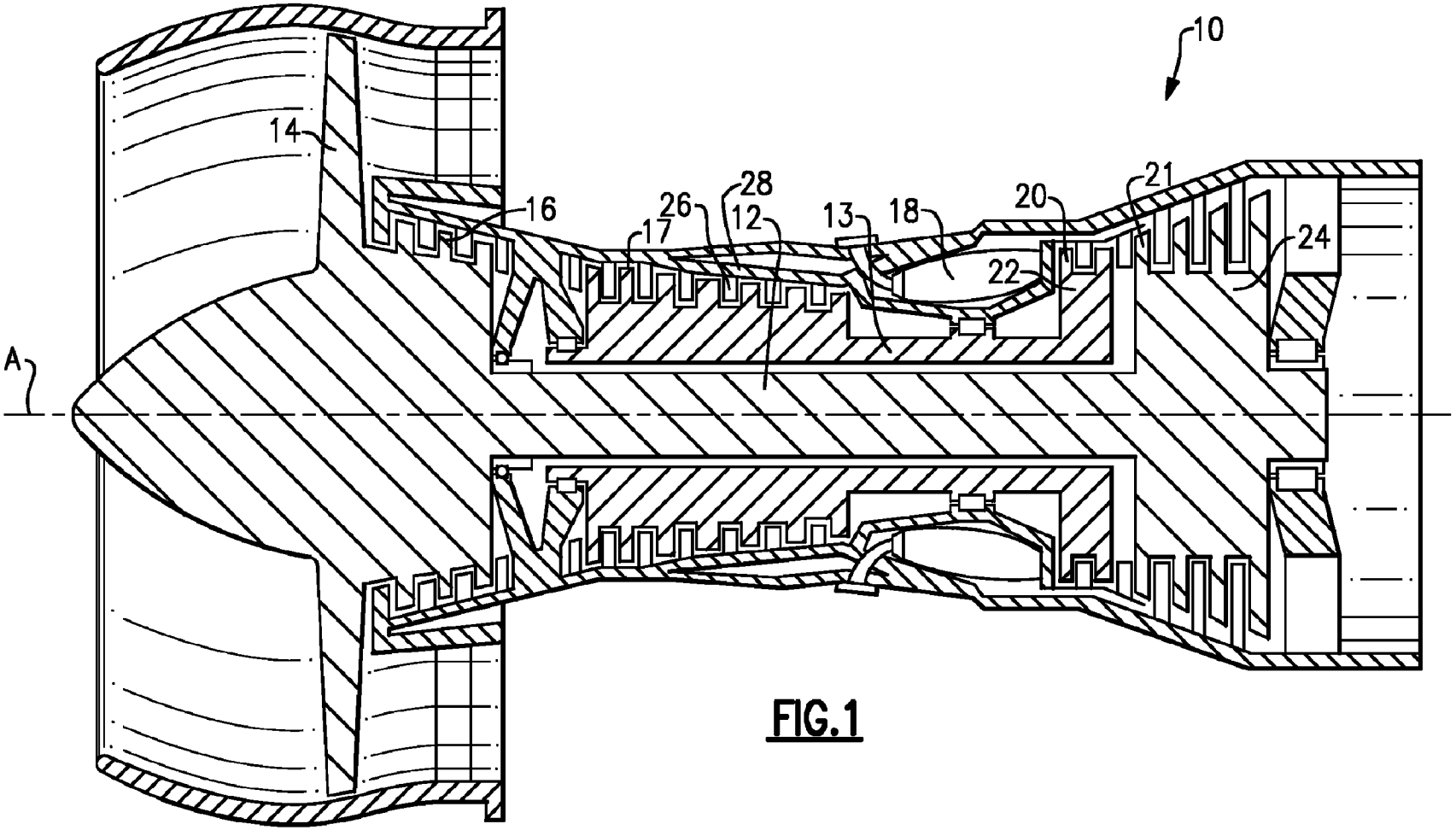
FIG. 1 is a simplified cross-sectional view of an example turbine engine.

One example turbine engine 10 is shown schematically in FIG. 1. As known, a fan section moves air and rotates about an axis A. A compressor section, a combustion section, and a turbine section are also centered on the axis A. FIG. 1 is a highly schematic view, however, it does show the main components of the gas turbine engine. Further, while a particular type of gas turbine engine is illustrated in this figure, it should be understood that the claim scope extends to other types of gas turbine engines.

The engine 10 includes a low spool 12 rotatable about an axis A. The low spool 12 is coupled to a fan 14, a low pressure compressor 16, and a low pressure turbine 24. A high spool 13 is arranged concentrically about the low spool 12. The high spool 13 is coupled to a high pressure compressor 17 and a high pressure turbine 22. A combustor 18 is arranged between the high pressure compressor 17 and the high pressure turbine 22.

The high pressure turbine 22 and low pressure turbine 24 typically each include multiple turbine stages. A hub supports each stage on its respective spool. Multiple turbine blades are supported circumferentially on the hub. High pressure and low pressure turbine blades 20, 21 are shown schematically at the high pressure and low pressure turbines 22, 24. Stator vanes 26 are arranged between the different stages.

Figure 2:
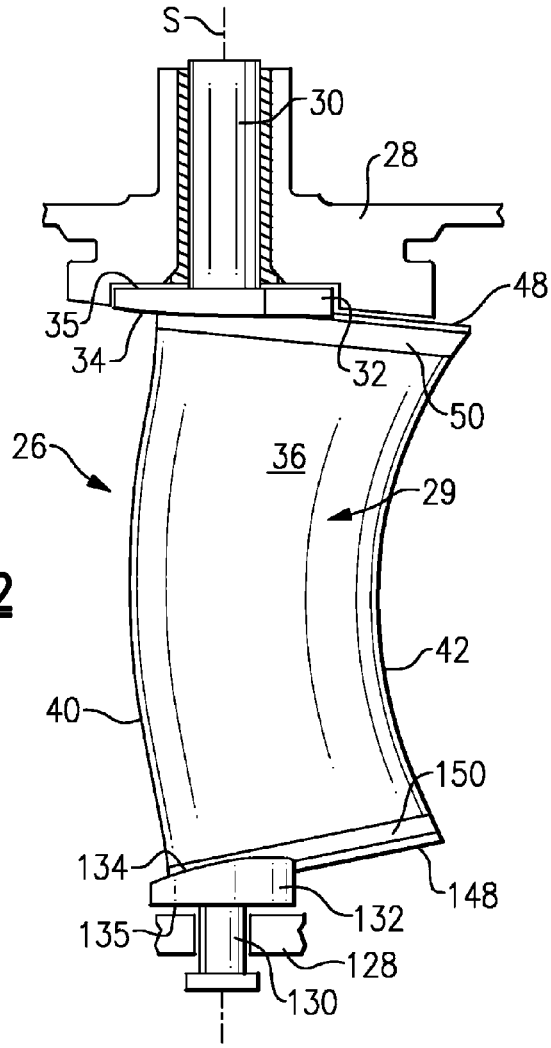
FIG. 2 is a partial cross-sectional view of a variable stator assembly.

Like numerals are used for the features of the stator vane at its outer and inner diameters. However, it should be understood that some of the example features may be used on only one end of the stator vane 26, if desired. Referring to FIG. 2, an example variable stator vane 26 is shown in more detail. The stator vane 26 includes outer and inner trunnions 30, 130 that support the stator vane 26 for rotation about a stator axis S within outer and inner cases 28, 128. An airfoil 29 extends between an outer platform or button 32 and an inner platform or button 132. The outer and inner platforms 32, 132 respectively include opposing surfaces 34, 35 and 134, 135, which are adjoined by circumferences. Outer and inner trunnions 30, 130 extend from the opposing surfaces 35, 135, and the airfoil is supported by and extends from the other opposing surface 34, 134. The airfoil 29 includes opposing pressure and suction sides 36, 38. The pressure side 36 is concave in shape and the suction side 38 (best shown in FIG. 6) is convex.

The airfoil 29 extends laterally from a leading edge 40 to a trailing edge 42. In one example, the leading edge 40 is inset from the platforms 32, 132. The airfoil 29 includes an overhanging portion that extends beyond the circumferences of the platforms 32, 132 to the trailing edge 42.

Figure 3:
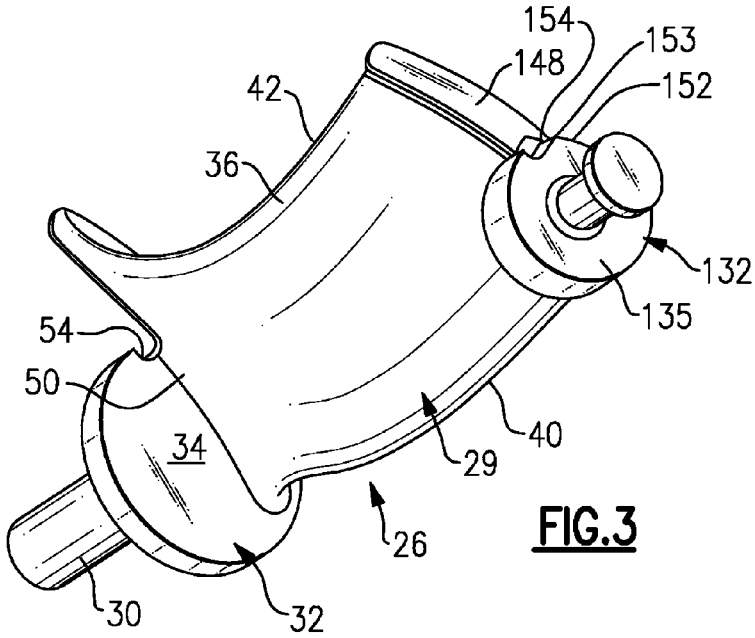
FIG. 3 is a perspective view of an example variable stator vane from an inner diameter and pressure side.
Figure 4:
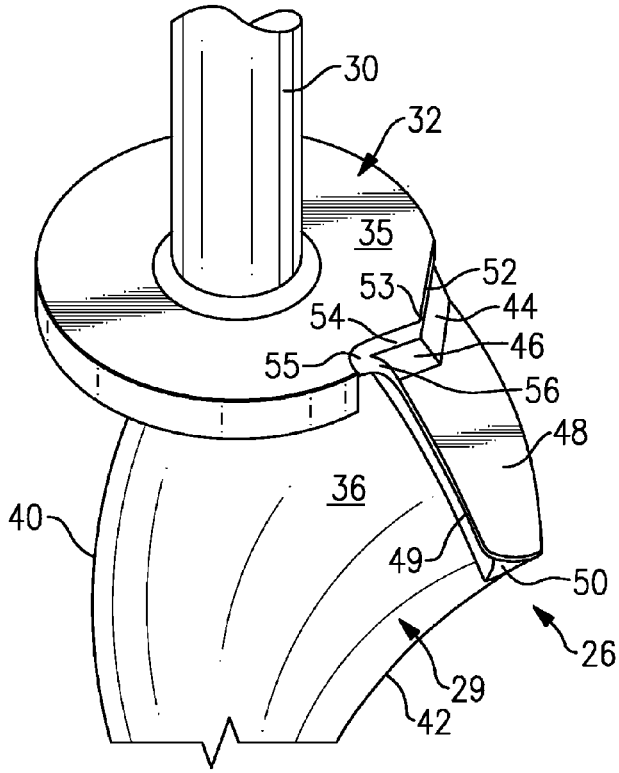
FIG. 4 is a perspective view of an outer diameter of the variable stator vane.
Figure 5:
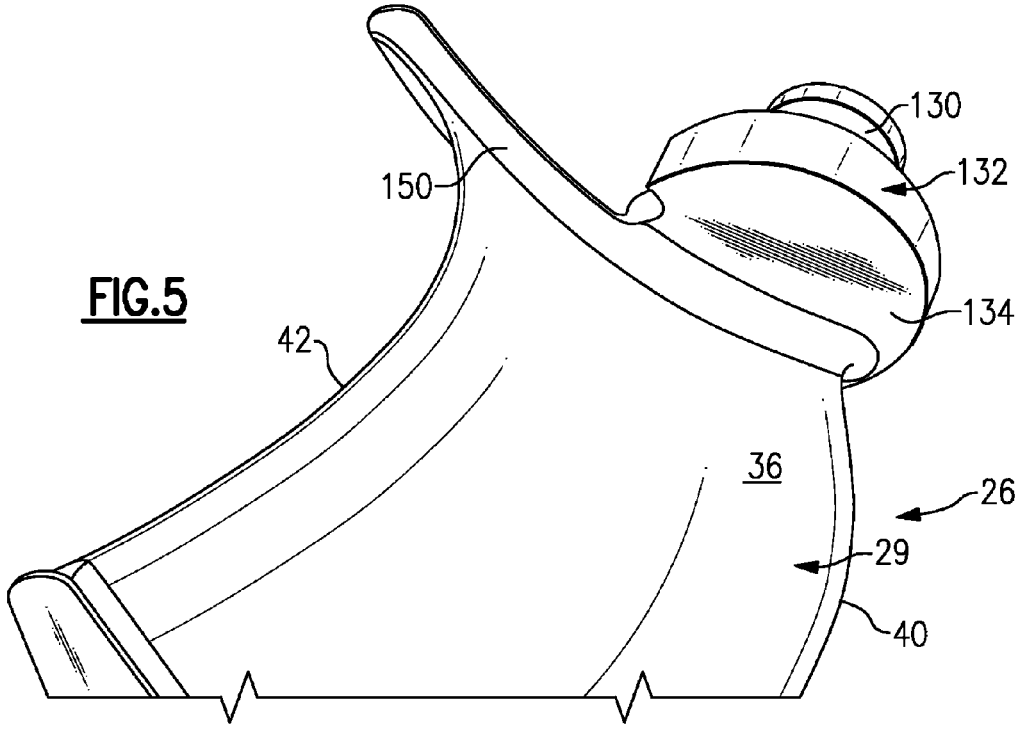
FIG. 5 is a perspective view of the variable stator vane from the outer diameter in the direction of the inner diameter and the pressure side.

Referring to FIGS. 2-4, the overhanging portion of the airfoil 29 terminates axially in outer and inner end surfaces 48, 148. The end surfaces 48, 148 are provided by a generally flat or planar surface that is wider than the thickness of the airfoil 29. A fillet 50 adjoins the airfoil 29 and the surface 34 of the outer platform 32, as shown in FIGS. 2 and 3. Unlike the prior art, the fillet 50 extends beyond the surface 34 beyond the circumference of the platform 32 toward the trailing edge 42. In one example, the fillet 50 wraps around the entire perimeter of the airfoil 29. A fillet 150 is provided at the inner diameter of the stator vane 26 in a similar fashion, as shown in FIG. 5.

Referring to FIG. 4, the overhanging portion of the airfoil 29 includes an edge 49 that wraps around the perimeter of the end surface 48 that extends beyond the circumference of the platform 32. The edge 49 has a thickness greater than zero so as to avoid creating a stress riser at the junction of the end surface 48 and the fillet 50. Similarly, the inner diameter overhanging portion includes an edge 149 having a thickness greater than zero.

Figure 6:
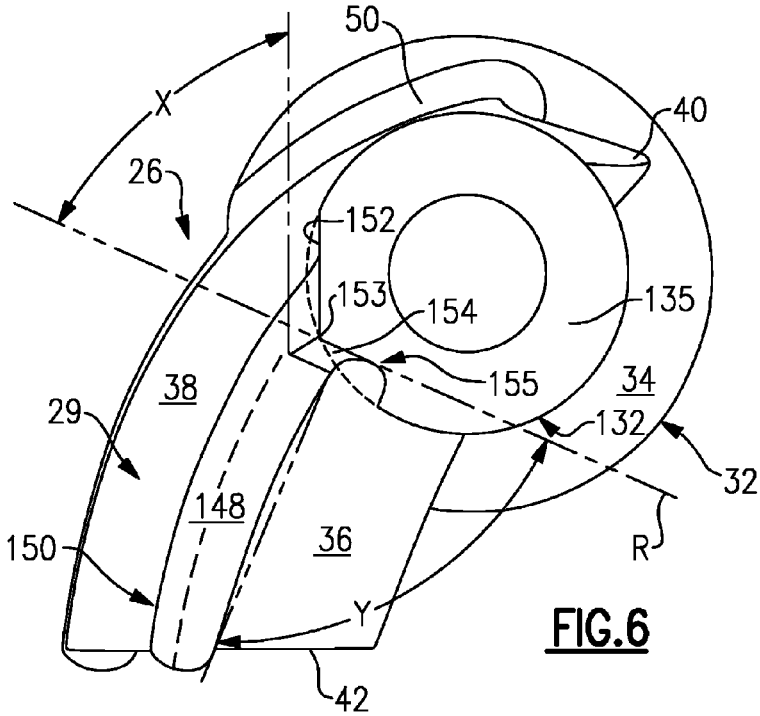
FIG. 6 is an end view of the inner diameter of the variable stator vane.
Figure 7:
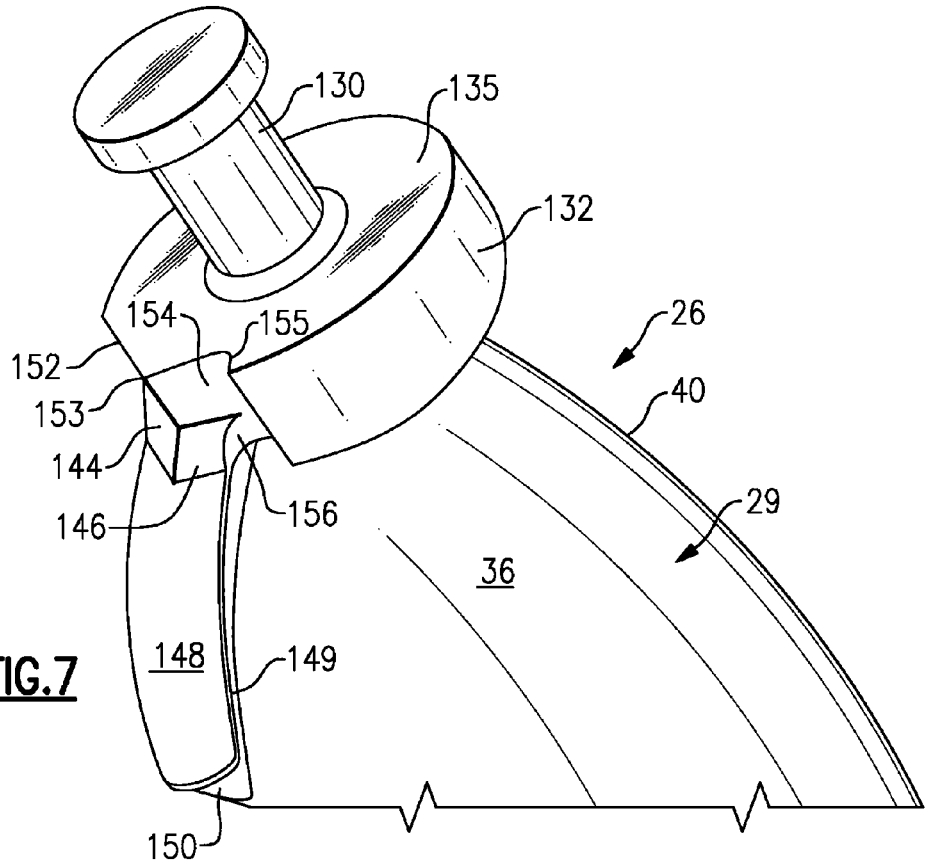
FIG. 7 is a perspective view of the inner diameter of the variable stator vane.

Referring to FIGS. 4, 6 and 7, the platform 32 includes a relief cut 52 and a notch 54 forming an apex 53 that overlays the end surface 48. In this manner, the zero thickness region sometimes resulting from a single cut is avoided. In one example, the notch 54 includes a radius 55 that extends into the fillet 50. The edge 49 blends into the radius 55, best shown in FIG. 4. A reference line R is shown perpendicular to a trailing edge chord line. The notch 154 is generally perpendicular to the trailing edge chord line, shown by angle Y in FIG. 6. The angle Y is selected to eliminate zero transition thickness between the fillet 150 and the notch 154. As a result, the notch 154 has a reduced impact or aerodynamic efficiency. To further improve efficiency, the notch may extend in a linear direction from the apex 153 along the path shown. The relief cut 152 is at a generally acute angle X relative to the reference line R. The angle X is selected to eliminate zero thickness between the fillet 150 and the relief cut 152.

Referring to FIG. 4, transition surfaces 44, 46 (144, 146 in FIG. 7) provide a fillet and respectively slope from the relief cut and notch 52, 54 to the end surface 48. In this manner, any sharp angles that may create a stress riser are eliminated thereby reducing the potential for high stress where the airfoil 29 overhangs the platforms 32, 132.

Although a preferred embodiment has been disclosed, a worker of ordinary skill in this art would recognize that certain modifications would come within the scope of the claims. For that reason, the following claims should be studied to determine their true scope and content.

What is claimed is:

1. A variable stator vane for a turbine engine comprising:

a platform having a circumference adjoining opposing surfaces, and a trunnion extending from one of the opposing surfaces;

an airfoil supported on the other of the opposing surfaces opposite the trunnion, the airfoil including leading and trailing edges, and an overhanging portion that includes the trailing edge, which includes an end surface that extends beyond the circumference; and a fillet joining the airfoil and the other opposing surface and extending along the other opposing surface in a lateral direction beyond the circumference toward the trailing edge, wherein the fillet extends laterally about an entire perimeter of the airfoil at the other opposing surface and the end surface.

2. The stator vane according to claim 1, wherein the end surface is generally planar.

3. The stator vane according to claim 2, wherein the end surface has a width that is greater than an airfoil thickness, with an edge extending about the overhanging portion between the end surface and the fillet, the edge thickness greater than zero.

4. The stator vane according to claim 1, wherein the fillet wraps around the trailing edge and extends to the platform.

5. The stator vane according to claim 1, wherein the platform includes a relief cut adjoining a notch to form an apex overlaying the end surface.

6. The stator vane according to claim 5, wherein the notch includes a radius overlapping the fillet on the platform.

7. The stator vane according to claim 5, comprising transition surfaces sloping from the relief cut and notch toward the end surface.

8. The stator vane according to claim 1, wherein the leading edge is inset from the circumference.

9. A variable stator vane for a turbine engine comprising:

a platform having a circumference adjoining opposing surfaces, and a trunnion extending from one of the opposing surfaces;

an airfoil supported on the other of the opposing surfaces opposite the trunnion and including pressure and suction sides, the airfoil including leading and trailing edges, and an overhanging portion that includes the trailing edge, which includes an end surface between the pressure and suction sides extending beyond the circumference; and wherein the circumference includes a relief cut extending from the suction side and adjoining a notch in the circumference to form an apex overlying the end surface.

10. The stator vane according to claim 9, wherein the notch includes an axially extending radius.

11. The stator vane according to claim 10, comprising a fillet joining the airfoil and the other opposing surface, wherein the radius overlaps the fillet on the platform.

12. The stator vane according to claim 9, wherein transition surfaces slope from the relief cut and notch toward the end surface.

13. The stator vane according to claim 9, wherein the end surface is generally planar, the end surface having a width greater than an airfoil thickness extending between the pressure and suction sides, the end surface extending away from the circumference toward the trailing edge.

14. The stator vane according to claim 13, comprising a fillet joining the airfoil and the other opposing surface and extending along the other opposing surface in a lateral direction beyond the circumference toward the trailing edge, wherein an edge adjoins the fillet and the end surface and wraps around the overhanging portion, the edge including a thickness that is greater than zero about the entire perimeter of the overhanging portion.

15. The stator vane according to claim 9, wherein the notch is generally perpendicular to a trailing edge chord reference line.

16. The stator vane according to claim 15, wherein the relief cut is at an obtuse angle relative to the trailing edge chord reference line.

17. The stator vane according to claim 9, wherein the pressure side includes a concave shape and the suction side includes a convex shape.

* * * * *